US008730227B2

(12) United States Patent
Lee et al.

(10) Patent No.: US 8,730,227 B2
(45) Date of Patent: May 20, 2014

(54) DRIVING DEVICE, LIQUID CRYSTAL DISPLAY HAVING THE SAME, AND METHOD OF DRIVING THE LIQUID CRYSTAL DISPLAY

(75) Inventors: Kyung-Hun Lee, Masan-si (KR); Young-Gil Kim, Suwon-si (KR); Kyeong-Sik Cho, Cheonan-si (KR); So-Yeon Yi, Seoul (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1281 days.

(21) Appl. No.: 12/131,644

(22) Filed: Jun. 2, 2008

(65) Prior Publication Data

US 2009/0040244 A1 Feb. 12, 2009

(30) Foreign Application Priority Data

Aug. 8, 2007 (KR) ..... 10-2007-0079661

(51) Int. Cl.
*G09G 5/00* (2006.01)

(52) U.S. Cl.
USPC ..... 345/212; 345/87; 345/204; 345/211

(58) Field of Classification Search
USPC ..... 345/87–100, 211–213, 204
See application file for complete search history.

(56) References Cited

U.S. PATENT DOCUMENTS 6,256,025 B1 * 7/2001 Imai et al. ..... 345/211
6,459,399 B1 * 10/2002 Nozaki ..... 341/155
7,864,170 B2 * 1/2011 Kida et al. ..... 345/211
7,940,286 B2 * 5/2011 Pan et al. ..... 345/690
2002/0075255 A1 * 6/2002 Baek et al. ..... 345/212
2002/0149541 A1 * 10/2002 Shin ..... 345/3.1
2003/0132906 A1 * 7/2003 Tanaka et al. ..... 345/89
2003/0151577 A1 * 8/2003 Morita ..... 345/89
2003/0189564 A1 * 10/2003 Lee et al. ..... 345/212
2004/0125068 A1 * 7/2004 Lee ..... 345/99
2005/0017992 A1 * 1/2005 Kudo et al. ..... 345/690
2005/0243046 A1 * 11/2005 Hong ..... 345/87
2005/0285832 A1 * 12/2005 Shin et al. ..... 345/87
2006/0007209 A1 * 1/2006 Nakamura et al. ..... 345/204
2007/0182670 A1 * 8/2007 Watanabe et al. ..... 345/75.2

FOREIGN PATENT DOCUMENTS

JP 2005-250034 9/2005
JP 2007-065134 3/2007
KR 1020020094348 12/2002

* cited by examiner

*Primary Examiner* — Gregory J Tryder
(74) *Attorney, Agent, or Firm* — F. Chau & Associates, LLC

(57) ABSTRACT

In a driving device, a liquid crystal display having the driving device, and a method of driving the liquid crystal display, the driving device includes a signal controller, a voltage selector, a gray-scale voltage generator, and a data driver. The signal controller outputs a power-down signal indicating an imminent power-off. The voltage selector outputs a common voltage in response to the signal. The gray-scale voltage generator receives the common voltage to generate common gray-scale voltages having a same voltage level as that of the common voltage. The data driver generates common data voltages based on the common gray-scale voltages. The driving device controls a display panel so that the display panel displays a white image in response to the signal. Thus, an after-image after the power-off is removed, therefore improving the display quality of the display panel.

13 Claims, 8 Drawing Sheets

DRIVING DEVICE, LIQUID CRYSTAL DISPLAY HAVING THE SAME, AND METHOD OF DRIVING THE LIQUID CRYSTAL DISPLAY

CROSS-REFERENCE TO RELATED APPLICATION

This application claims priority, under 35 USC §119, of Korean Patent Application No. 2007-79661 filed on Aug. 8, 2007, the entire contents of which are herein incorporated by reference.

BACKGROUND OF THE INVENTION

1. Field of the Invention

The present invention relates to a driving device, a liquid crystal display having the driving device, and a method of driving the liquid crystal display. More particularly, the present invention relates to a driving device capable of improving display quality, a liquid crystal display having the driving device, and a method of driving the liquid crystal display.

2. Description of the Related Art

Liquid crystal displays (LCD) that display an image using a liquid crystal layer are widely used as flat panel display devices in computers, televisions, digital cameras, cell phones and other electronic devices. An LCD typically includes a liquid crystal display panel and a driver circuit. The liquid crystal display panel displays an image in response to data voltages provided from the driver applied to its pixels. The driver receives an image signal and an image control signal from exterior source to generate the data voltages.

When data voltages each having the same polarity and the same voltage level are applied to a pixel in the liquid crystal layer during several consecutive frames, electric charges accumulate in the liquid crystal layer. If the accumulated electric charges are not completely discharged, a lingering after-image occurs.

For example, when a pixel in the LCD is turned OFF, the after-image remains, due to the non-discharge of the accumulated electric charge, and gradually disappears from the liquid crystal display panel, thereby causing deterioration of the image display quality of the LCD.

SUMMARY OF THE INVENTION

An aspect of the present invention provides a driving device capable of reducing an after-image to improve a display quality.

Another aspect of the present invention also provides a liquid crystal display having the driving device.

Another aspect of the present invention also provides a method of driving the liquid crystal display.

According to one aspect of the present invention, a driving device for outputting data voltages to a plurality of data lines of an LCD panel, comprising a data driver configured to output the data voltages wherein during a power-down mode, indicated by a logic state of a power-down mode signal, after the normal display mode, the voltage level of all of the data voltages is substantially the same. During the normal display mode, the voltage level of each data voltage is based on dynamically selecting one among a plurality of normal gray-scale voltages, wherein each of the normal gray-scale voltages is different, and wherein each selection is based on received image data. The driving circuit may also include a voltage selector having first and second output terminals and configured to receive the power-down mode signal, a first voltage, a second voltage having a lower voltage level than that of the first voltage, and a third voltage between the first voltage and the second voltage, and configured to output the first voltage and the second voltage at its first and second output terminals, respectively, during the normal display mode, and configured to output the third voltage to both of the first and second output terminals during the power-down mode. The driving device may further include a gray-scale voltage generator including first and second reference terminals respectively electrically connected to the first and second output terminals, and including a resistor string connected in series between the first reference terminal and the second reference terminal, wherein the gray-scale voltage generator is configured to generate the plurality of normal gray-scale voltages having different voltage levels by voltage-dividing the first and second voltages during the normal display mode, and configured to output a plurality of common gray-scale voltages during the power-down mode, wherein the gray-scale voltages output by the gray-scale voltage generator are output to the data driver.

According to another aspect of the present invention, a driving device includes a signal controller, a voltage selector, a gray-scale voltage generator, and a data driver.

The signal controller generates a data signal corresponding to an image, and a control signal indicating a power-down mode.

The voltage selector receives a first voltage, a second voltage, and a third voltage having a voltage level corresponding to between the first voltage and the second voltage, outputs either the first voltage or the third voltage through a first output terminal, and outputs either the second voltage or the third voltage through a second output terminal according to the control signal.

The gray-scale voltage generator includes first and second reference terminals respectively electrically connected to the first and second output terminals, receives the first and second voltages through the first and second output terminals, respectively, to generate first (normal) gray-scale voltages having different voltage levels, and receives the third voltage through the first and second reference terminals during the power-down to generate second (common) gray-scale voltages each having the same voltage level as that of the third voltage level.

The data driver changes the data signal to a positive/negative data voltage using the first (normal) gray-scale voltages to output the positive/negative data voltage and changes the data signal to a common data voltage using the second (common) gray-scale voltages to output the common data voltage.

In another aspect of the present invention, a liquid crystal display includes a signal controller, a voltage selector, a gray-scale voltage generator, a data driver, and a liquid crystal display panel.

The signal controller generates a data signal corresponding to an image and a control signal indicating a power-down;

The voltage selector receives a first voltage, a second voltage, and a third voltage having a voltage level corresponding to between the first voltage and the second voltage, outputs either the first voltage or the third voltage through a first output terminal, and outputs either the second voltage or the third voltage through a second output terminal according to the control signal.

The gray-scale voltage generator includes first and second reference terminals respectively electrically connected to the first and second output terminals, receives the first and second voltages through the first and second output terminals, respectively, to generate first (normal) gray-scale voltages having different voltage levels, and receives the third voltage through the first and second reference terminals during the power-down to generate second (common) gray-scale voltages each having a same voltage level as that of the third voltage level.

The data driver changes the data signal to a positive/negative data voltage using the first (normal) gray-scale voltages to output the positive/negative data voltage and changes the data signal to a common data voltage using the second (common) gray-scale voltages to output the common data voltage.

The liquid crystal display panel displays a normal image based on the positive/negative data voltage and displays an abnormal image based on the common data voltage during the power-down.

In further aspect of the present invention, a method of driving a liquid crystal display is provided as follows. First (normal) gray-scale voltages corresponding to between a first voltage and a second voltage are generated to have different voltage levels from each other. Second (common) gray-scale voltages corresponding to an intermediate value between the first voltage and the second voltage are generated during a power-down to have the same voltage level as that of a third voltage. A data signal corresponding to an image is changed to a first data voltage using the first (normal) gray-scale voltages, and the data signal corresponding to the image is changed to a second data voltage using the second (common) gray-scale voltages generated during the power-down of the liquid crystal display. Then, a normal image corresponding to the first data voltage is displayed through the liquid crystal display, and during the power-down, an abnormal image corresponding to the second data voltage is displayed through the liquid crystal display.

According to the above, the liquid crystal display displays a white image during the power-down. The data voltage corresponding to the white image has a voltage level that is equal to or near to the common voltage. Thus, electric charges accumulated in the liquid crystal layer may be easily discharged, thereby removing an after-image effectively during the power-down of the liquid crystal display.

It will be understood that when an element is referred to as being "connected to" or "coupled to" another element, it can be directly connected or coupled to the other element or intervening elements may be present. In contrast, when an element is referred to as being "directly connected to" or "directly coupled to" another element, there are no intervening elements present. Like numbers refer to like elements throughout. As used herein, the term "and/or" includes any and all combinations of one or more of the associated listed items.

It will be understood that, although the terms first, second, etc. may be used herein to describe various elements, components, regions, and/or parts, these elements, components, regions, layers and/or parts should not be limited by these terms. These terms are only used to distinguish one element, component, region, layer or part from another region, layer or part. Thus, a first element, component, region, layer or part discussed below could be termed a second element, component, region, layer or part without departing from the teachings of the present invention.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "having", "includes" and/or "including", when used in this specification, specify the presence of stated features, integers, steps, operations, elements, and/or components, but do not preclude the presence or addition of one or more other features, integers, steps, operations, elements, components, and/or groups thereof.

BRIEF DESCRIPTION OF THE DRAWINGS

The above and other features of the present invention will become readily apparent by reference to the following detailed description when considered in conjunction with the accompanying drawings, wherein.

DETAILED DESCRIPTION OF EXEMPLARY EMBODIMENTS OF THE INVENTION

In the exemplary embodiments that will be described hereinafter, the terms of a first voltage, a second voltage, and a third voltage used in claims represent an positive power voltage +AVDD, a negative power voltage −AVDD, and a common voltage Vcom, respectively. Accordingly, the first, second, and third voltages will be referred to hereinafter as the positive power voltage +AVDD, the negative power voltage −AVDD, and the common voltage Vcom, respectively.

Also, the terms first gray-scale voltages and second gray-scale voltages used in claims represent the normal gray-scale voltages and the common (abnormal) gray-scale voltages, respectively. Accordingly, the terms first gray-scale voltages and second gray-scale voltages will be referred to hereinafter with the normal gray-scale voltages and the common gray-scale voltages.

Figure 1:
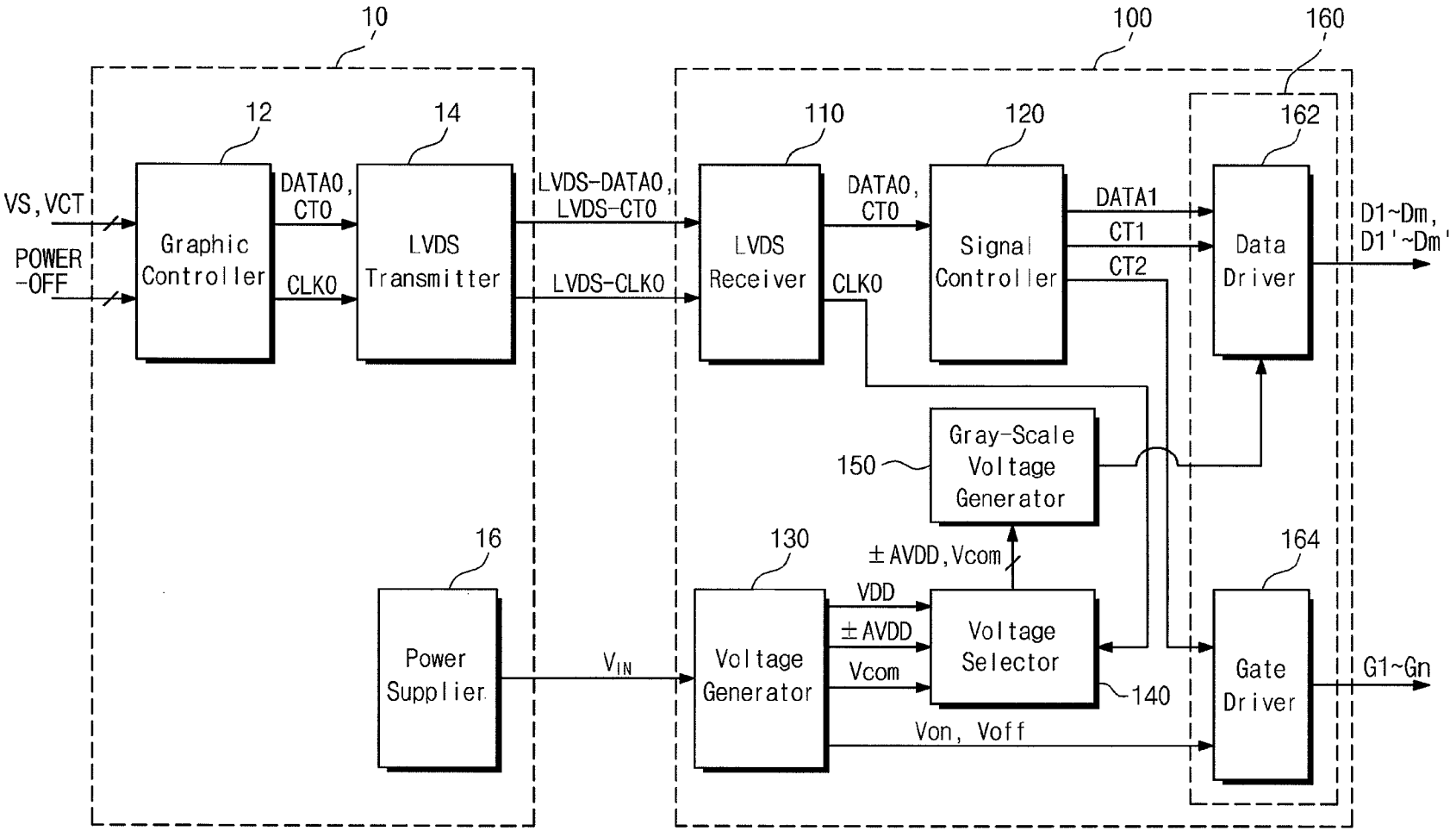
FIG. 1 is a block diagram of an exemplary embodiment of a driving device according to the present invention.

FIG. 1 is a block diagram of a driving device according to an exemplary embodiment of the present invention. In FIG. 1, an external system that performs a data communication with the driving device will is additionally shown for the convenience of description.

Referring to FIG. 1, a driving device 100 is electrically connected to a liquid crystal display panel 200 (not shown in FIG. 1, see FIG. 7) that displays an image. The driving device 100 controls the liquid crystal display panel 200 to allow the liquid crystal display panel 200 to display a normal image and to display an abnormal (e.g., all-white) image. The abnormal image is typically a full-white image displayed during a power-down at which time the normal display operation (normal mode) of the liquid crystal display panel stops. Since the driving device 100 controls the liquid crystal display panel 200 such that the liquid crystal display panel 200 displays the full-white image during the power-down signal/event, an after-image which is generally visible during and/or after the power-down may be avoided. Accordingly, a liquid crystal display (LCD) employing the driving device 100 may provide improved performance.

The driving device 100 includes a signal controller 120 configured to receive and transmit data with an external system 10, a voltage generator 130 configured to generate various reference voltages applied to generate gray-scale voltages $V_G$, a voltage selector 140 configured to selectively output the reference voltages, a gray-scale voltage generator 150 configured to generate the gray-scale voltages $V_G$ using the selectively output reference voltages, and a driver 160 configured to output data voltages D1~Dm corresponding to the gray-scale voltages $V_G$ to the liquid crystal display panel according to a control of the signal controller 120.

Also, the driving device 100 further includes a low voltage differential signaling (LVDS) receiver 110 that is interfaced with the external system 10 for the data communication between the external system 10 and the driving device 100.

The external system 10 includes a graphic controller 12, an LVDS transmitter 14, and a power supplier 16.

The graphic controller 12 receives a video signal VS and a video control signal VCT that controls the video signal VS and changes the video signal VS and the video control signal VCT to an image signal DATAO in a digital form and an image control signal CTO that controls the image signal DATAO, respectively, to output the image signal DATAO in the digital form and the image control signal CTO. Also, the graphic controller 12 configured to output a power-down control signal (e.g. an enabled clock signal) CLKO that stops the operation of the driving device 100 in response to an external power-down signal POWER-OFF. The power-down control signal CLKO is in a digital (e.g., binary) form and may include multiple parallel data bits. The graphic controller 12 changes the power-down control signal CLKO from an inactivated state to an activated state in response to the external power-down signal POWER-OFF. The power-down control signal CLKO may be synchronized with the data control (clock) signal CT1 and so may be implemented as a gated clock signal.

The power supplier 16 provides an alternating current (AC) voltage $V_{IN}$ within a range from 100 volts to 240 volts to the voltage generator 130 arranged in the driving device 100 in order to operate the driving device 100.

Meanwhile, in order to reduce electromagnetic interference (EMI) between channels connecting the external system 10 and the driving device 100, the driving device 100 performs a data communication with the external system 10 using a differential signaling transmission method, such as the LVDS transmission method and a reduced swing differential signaling (RSDS) transmission method. In the present exemplary embodiment, the driving device 100 using only the LVDS transmission method will be described in detail.

In order to perform the data communication according to the LVDS differential signaling transmission method, the external system 10 includes the LVDS transmitter 14 and the driving device 100 includes the LVDS receiver 110.

The LVDS transmitter 14 changes the image signal DATAO, the image control signal CTO, and the power-down control signal CLKO from the graphic controller 12 to a differential image signal LVDS-DATAO, a differential image control signal LVDS-CTO, and a differential power-down control (enabled clock) signal LVDS-CLKO, respectively, and outputs the differential image signal LVDS-DATAO, the differential image control signal LVDS-CTO, and the differential power-down control signal LVDS-CLKO.

The differential image signal LVDS-DATAO, the differential image control signal LVDS-CTO, and the differential power-down control signal LVDS-CLKO are output to the LVDS receiver 110 in the driving device 100 through at least one channel.

The LVDS receiver 110 receives the differential image signal LVDS-DATAO, the differential image control signal LVDS-CTO, and the differential power-down control signal LVDS-CLKO and restores the image signal DATAO, the image control signal CTO, and the power-down control signal CLKO from the differential image signal LVDS-DATAO, the differential image control signal LVDS-CTO, and the differential power-down control signal LVDS-CLKO.

The restored image signal DATAO and the restored image control signal CTO are applied to the signal controller 120, and the restored power-down control (enabled clock) signal CLKO (hereinafter, referred to as a power-down control signal and/or a power-down mode-indicating signal) is applied to the voltage selector 140.

The signal controller 120 receives the image data DATAO and the image control signal CTO and changes the image data DATAO and the image control signal CTO. The signal controller 120 receives data signal DATA1 and the control signals CT1 and CT2, respectively, to output the data signal DATA1 and the control signals CT1 and CT2.

The control signals CT1 and CT2 include a data control signal CT1 and a gate control signal CT2.

The data control signal CT1 is applied to a data driver 162 of the driver 160 with the data signal DATA1 and controls parallel output of data voltages D1~Dm from the data driver 162. The gate control signal CT2 is applied to a gate driver 164 of the driver 160 and controls sequential output of gate voltages G1~Gn from the gate driver 164.

The voltage generator 130 receives the alternating current (AC) power voltage $V_{IN}$ from the power supplier 16 in the external system 10 to generate a power voltage VDD, an positive power voltage +AVDD, an negative power voltage −AVDD, and a common voltage Vcom supplied to the voltage selector 140. The control signal CLK0 is applied to the voltage selector 140 and controls output of voltages +AVDD, −AVDD, and Vcom that are output from the voltage selector 140.

positive power voltage +AVDD negative power voltage −AVDD

Although not shown in FIG. 1, the voltage generator 130 may further include an AC-DC rectifier (not shown) and a DC-DC converter (not shown).

The AC-DC rectifier may have a power factor correction function and changes (rectifies) the alternating current (AC) power voltage $V_{IN}$ to a direct current (DC) voltage having a high voltage level.

The DC-DC converter changes the direct current voltage having the high voltage level provided from the AC-DC rectifier to generate the power voltage VDD, the positive power voltage +AVDD used to control transmittance of liquid crystals of the liquid crystal display panel. The DC-DC converter also generates the negative power voltage −AVDD that is opposite to the positive power voltage +AVDD, and the common voltage Vcom. In the present exemplary embodiment, the common voltage Vcom has a voltage level that is substantially equal to the intermediate (e.g., mean) value between the positive power voltage +AVDD and the negative power voltage −AVDD.

The voltage selector 140 receives the power voltage VDD, the positive power voltage +AVDD, the negative power voltage −AVDD, the common voltage, and the restored control signal CLKO from the LVDS receiver 120.

The voltage selector 140 outputs the common voltage Vcom and selectively outputs either one of the positive power voltage +AVDD and the negative power voltage −AVDD according to the logic state of the control signal CLKO that indicates a power-down mode.

The gray-scale voltage generator 150 generates normal gray-scale voltages and common gray-scale voltages using the selectively output voltages.

The driver 160 includes the data driver 162 and the gate driver 164.

The data driver 162 changes the data signal DATA1 from the signal controller 120 to normal the data voltages D1~Dm using the normal gray-scale voltages provided from the gray-scale voltage generator 150.

Meanwhile, during the power-down of the driving device 100, the data driver 162 changes the data signal DATA1 to common data voltages D1'~Dm' using the common gray-scale voltages provided from the gray-scale voltage generator 150.

The data driver 162 outputs a selection among the image data voltages D1~Dm and the common data voltages D1'~Dm' to the liquid crystal display panel 200 (shown in FIG. 7) in response to the data control signal CT1 from the signal controller 120.

The gate driver 164 changes the gate signals among voltages Von and Voff provided from the voltage generator 130 to output gate voltages G1~Gn in response to the gate control signal CT2 from the signal controller 120 and outputs the gate voltages G1~Gn to the liquid crystal display panel.

The liquid crystal display panel (200 in FIG. 7) receives the image data voltages D1~Dm and the gate voltages G1~Gn provided from the driver 160 to display an image, and during the power-down, the liquid crystal display panel receives the common data voltages D1'~Dm' and the gate voltages G1~Gn to display an abnormal (white) image.

Figure 2:
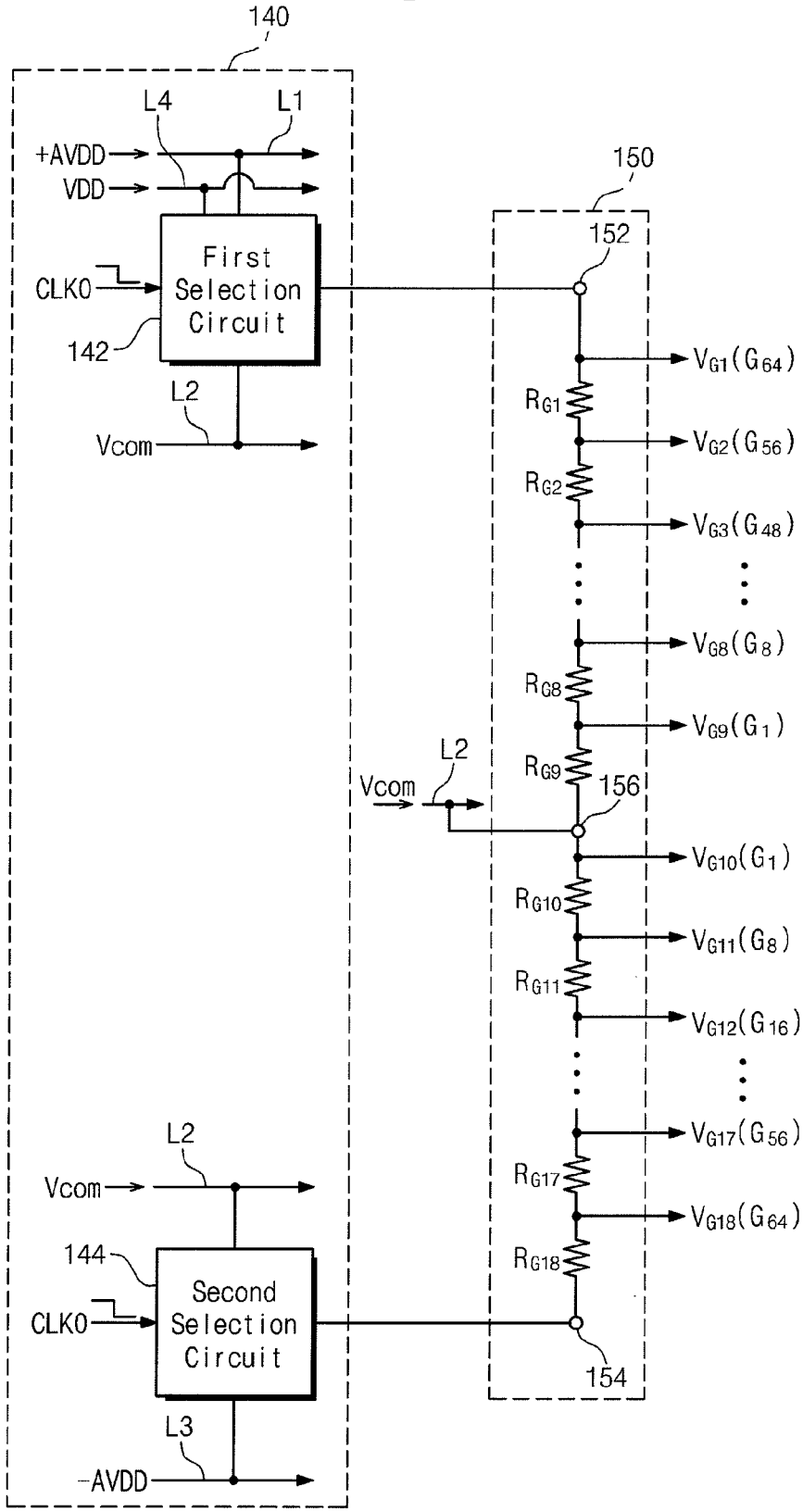
FIG. 2 is a circuit diagram of a voltage selector and a gray-scale voltage generator of FIG. 1.
Figure 3:
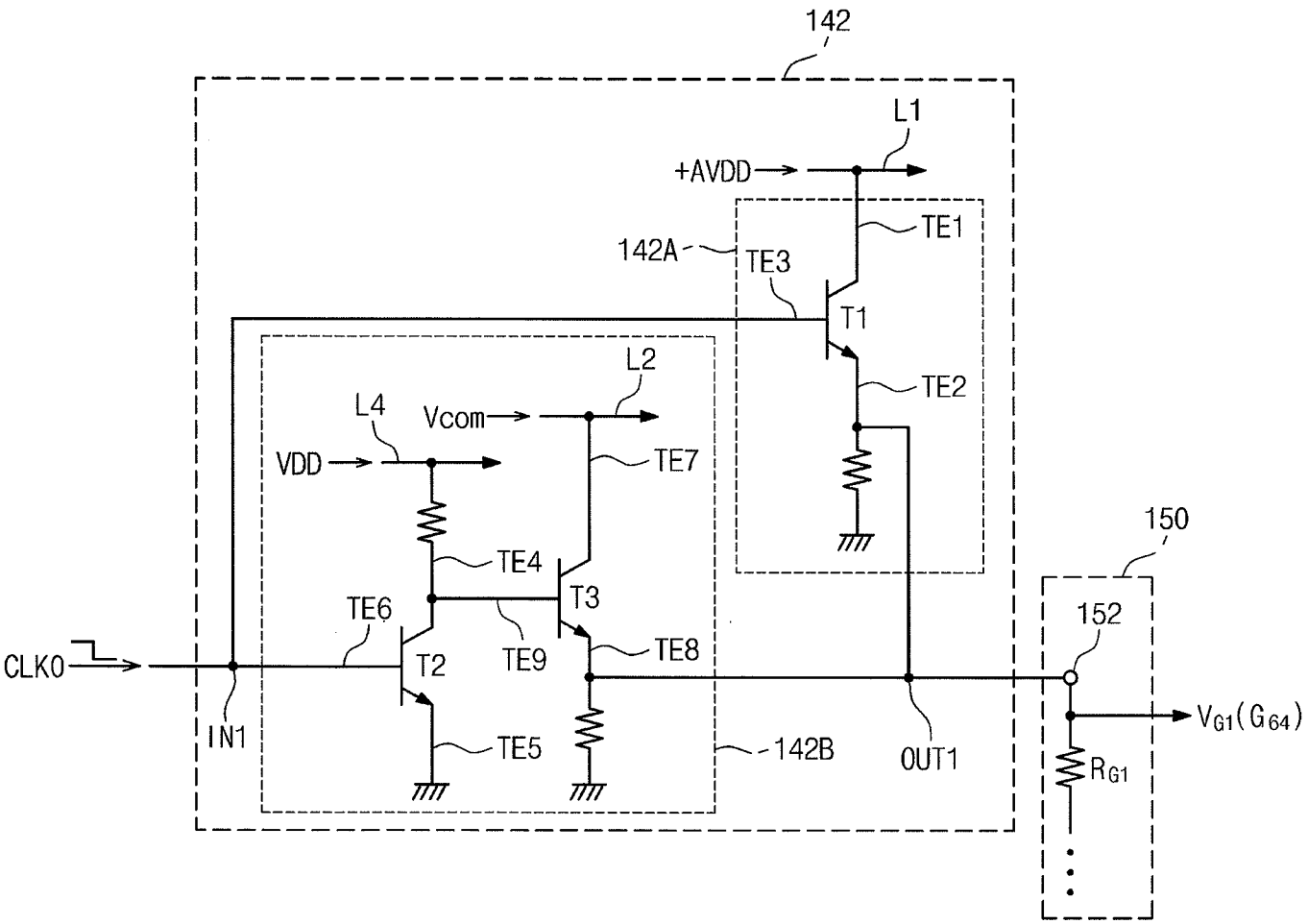
FIG. 3 is a circuit diagram of a first selection circuit and a gray-scale voltage generator of FIG. 2.
Figure 4:
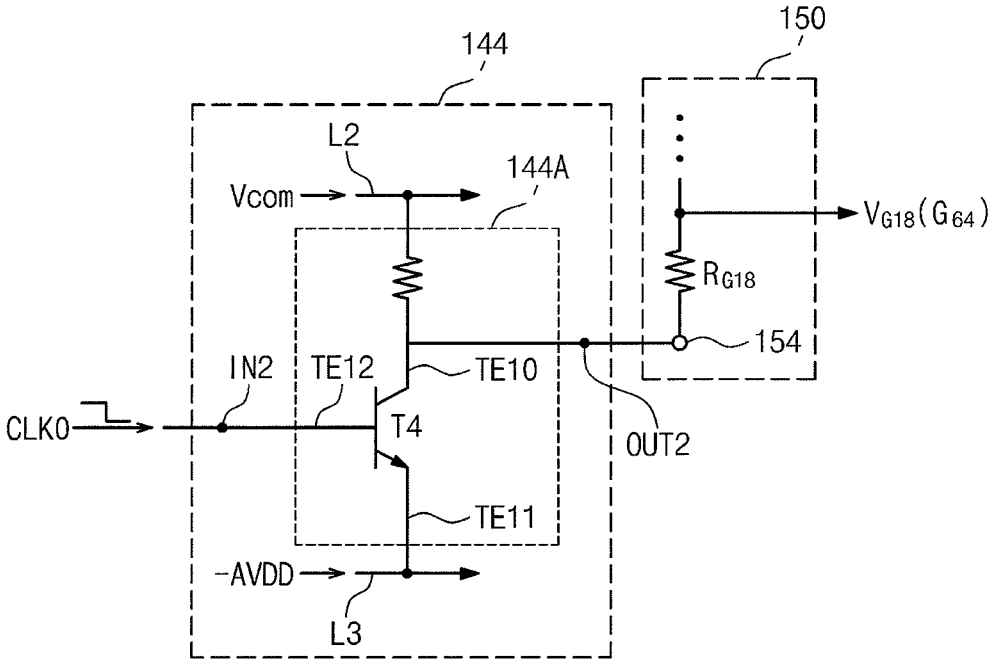
FIG. 4 is a circuit diagram of a second selection circuit and a gray-scale voltage generator of FIG. 2.

FIG. 2 is a circuit diagram showing the configuration of the voltage selector 140 of FIG. 1, FIG. 3 is a circuit diagram of the first selection circuit of FIG. 2, and FIG. 4 is a circuit diagram of the second selection circuit of FIG. 2. In FIG. 2, the gray-scale voltage generator 150 of FIG. 1 is additionally illustrated for a convenience of description. Also, in FIGS. 3 and 4, parts of the gray-scale voltage generator 150 of FIG. 2 are additionally illustrated.

Referring to FIG. 2, the voltage selector 140 includes a first selection circuit 142 and a second selection circuit 144.

The first selection circuit 142 receives the control signal CLKO provided from the LVDS receiver 110 and selectively outputs either the positive power voltage +AVDD or the common voltage Vcom according to the logic state of the control signal CLKO. The second selection circuit 144 receives the control signal CLKO provided from the LVDS receiver 110 and selectively outputs either the negative power voltage −AVDD or the common voltage Vcom according to the logic state of the control signal CLKO.

Referring to FIG. 3, the first selection circuit 142 includes a first input terminal IN1 to which the control signal CLKO is applied, a first output terminal OUT1 from which either the positive power voltage +AVDD or the common voltage Vcom is selectively output, and a first switching part 142A and a second switching part 142B connected in parallel between the first input terminal IN1 and the first output terminal OUT1.

The first switching part 142A includes a first switching device T1. The first switching device T1 includes a first terminal TE1 electrically connected to a first power line L1 that transmits the positive power voltage +AVDD, a second terminal TE2 electrically connected to the first output terminal OUT1, and a third terminal TE3 electrically connected to the first input terminal IN1.

The second switching part 142B includes a second switching device T2 and a third switching device T3. The second switching device T2 includes a first terminal TE4 electrically connected to a fourth power line L4 that transmits the power voltage VDD provided from the voltage generator 130, a second terminal TE5 electrically connected to a ground voltage VSS, and a third terminal TE6 receiving the control signal CLKO.

The third switching device T3 includes a first terminal TE7 electrically connected to a second power line L2 that transmits the common voltage Vcom, a second terminal TE8 electrically connected to the first output terminal OUT1, and a third terminal TE9 electrically connected to the first terminal TE4 of the second switching device T2.

When the control signal CLKO in a logic high state is applied through the first input terminal IN1, the first and second switching devices T1 and T2 are turned ON, and the third switching device T3 is turned OFF. Thus, the positive power voltage +AVDD is output to the first output terminal OUT1 through the first switching device T1.

On the other hand, when the control signal CLKO in a logic low state is applied through the first input terminal IN1, the first and second switching devices T1 and T2 are turned OFF, and the third switching device T3 is turned ON. Accordingly, the common voltage Vcom is output to the first output terminal OUT1 through the third switching device T3.

Referring to FIG. 4, the second selection circuit 144 includes a second input terminal IN2 to which the control signal CLKO is applied, a second output terminal OUT2 from which either the negative power voltage −AVDD or the common voltage Vcom is selectively output, and a third switching part 144A connected between the second input terminal IN2 and the second output terminal OUT2.

The third switching part 144A includes a fourth switching device T4. The fourth switching device T4 includes a first terminal TE10 electrically connected to the second power line L2 that transmits the common voltage Vcom, a second terminal TE11 electrically connected to a third power line L3 that transmits the analog power voltage −AVDD provided from the voltage generator 130, and a third terminal TE12 electrically connected to the second input terminal IN2.

When the control signal CLKO in a logic high state is applied through the second input terminal IN2, the fourth switching device T4 is turned ON. Thus, the negative power voltage −AVDD is output to the second output terminal OUT2.

On the other hand, when the control signal CLKO in a logic low state is applied through the second input terminal IN2, the fourth switching device T4 is turned OFF. Accordingly, the common voltage Vcom is output to the first output terminal OUT1.

Consequently, the voltage selector 140 outputs the positive power voltage +AVDD and the negative power voltage −AVDD through the first and second output terminals OUT1 and OUT2, respectively, in response to the control signal CLKO in the logic high state. Also, the voltage selector 140 simultaneously outputs the common voltage Vcom to both the first and second output terminals OUT1 and OUT2 in response to the control signal CLKO in the logic low state that indicates the power-down mode of the driving device 100.

In the present exemplary embodiment, the first to fourth switching devices T1~T4 shown in FIGS. 1 to 4 are configured to have bi-polar transistors have been described, however, any power transistor having a switching function may be used as the switching devices. For example, persons skilled in the art will recognize that first and third switching devices T1, T3 can be replaced with positive field-effect (e.g., PMOS)

transistors and second and fourth switching devices T2, T4 can be replaced with negative field-effect (e.g., NMOS) transistors. Also, persons skilled in the art will recognize that the resistors in 142 and 144 may likewise be replaced with complementary NMOS and PMOS transistors to construct power-saving CMOS circuits.

Referring to FIG. 2, the gray-scale voltage generator 150 includes a first reference terminal 152, a second reference terminal 154, a third reference terminal 156, and resistor strings $R_{G1}$~$R_{G18}$.

The first reference terminal 152 is electrically connected to the first output terminal OUT1 of the first selection circuit 142 as shown in FIG. 3, the second reference terminal 154 is electrically connected to the second output terminal OUT2 of the second selection circuit 144 as shown in FIG. 4, and the third reference terminal 156 is electrically connected to the second power line L2 that transmits the common voltage Vcom from the voltage generator 130 to receive the common voltage Vcom.

The resistor strings $R_{G1}$~$R_{G18}$ include a plurality of resistors connected one after another, in series, between the first reference terminal 152 and the second reference terminal 154, and connecting portions of each resistor have different electric potentials from each other according to a voltage division rule. The electric potentials of the connecting portions of each resistor are defined as gray-scale voltages $V_{G1}$~$V_{G18}$.

When the positive power voltage +AVDD is applied to the first reference terminal 152 and the negative power voltage −AVDD is applied to the second reference terminal 154, the resistor strings $R_{G1}$~$R_{G18}$ generate positive gray-scale voltages $V_{G1}$~$V_{G9}$ and negative gray-scale voltage levels $V_{G9}$~$V_{G18}$ having different voltage levels from each other by voltage-dividing a voltage difference between the positive power voltage +AVDD and the negative power voltage −AVDD.

The normal gray-scale voltages $V_{G1}$~$V_{G18}$ are divided, with reference to the common voltage Vcom input through the third reference terminal 156, into ascending (positive polarity) gray-scale voltages $V_{G1}$~$V_{G9}$ of which the voltage levels are gradually ascending by a predetermined voltage level from the common voltage Vcom to the positive power voltage +AVDD according to gray-scale values $G_1$~$G_{64}$ and descending (negative polarity) gray-scale voltages $V_{G10}$~$V_{G18}$ of which the voltage levels are gradually descending by a predetermined voltage level from the common voltage Vcom to the negative power voltage −AVDD according to the gray-scale values $G_1$~$G_{64}$.

The lowest gray-scale voltage $V_{G9}$ that is substantially closest to the common voltage Vcom among the ascending (positive polarity) gray-scale voltages $V_{G1}$~$V_{G9}$ is defined as a first gray-scale $G_1$, and the highest gray-scale voltage $V_{G1}$ that is substantially farthest from the common voltage Vcom among the ascending (positive polarity) gray-scale voltages $V_{G1}$~$V_{G9}$ is defined as a sixty-fourth gray-scale $G_{64}$. In the present exemplary embodiment, the highest gray-scale voltage $V_{G1}$ is defined as the sixty-fourth gray-scale $G_{64}$, however, the highest gray-scale voltage may be defined as more than the 64-th gray-scale, for instance, 256-th gray-scale.

The highest gray-scale voltage $V_{G10}$ that is substantially closest to the common voltage Vcom among the descending (negative polarity) gray-scale voltages $V_{G10}$~$V_{G18}$ is defined as the first gray-scale $G_1$, and the lowest gray-scale voltage $V_{G18}$ that is substantially farthest from the common voltage Vcom among the descending (negative polarity) gray-scale voltages $V_{G10}$~$V_{G18}$ is defined as the sixty-fourth gray-scale $G_{64}$. When the highest gray-scale voltage $V_{G1}$ among the ascending (positive polarity) gray-scale voltages $V_{G1}$~$V_{G9}$ has a gray-scale value equal to or greater than 256-th gray-scale, the lowest gray-scale voltage $V_{G18}$ among the descending (negative polarity) gray-scale voltages $V_{G10}$~$V_{G18}$ has a gray-scale value equal to or greater than 256-th gray-scale. In the present exemplary embodiment, the common voltage Vcom has a voltage level of about 0 volts that is equal to an intermediate value between the positive power voltage +AVDD and the negative power voltage −AVDD.

The first gray-scale $G_1$ is a "white" gray-scale that is represented as the brightest color on the liquid crystal display panel, and the 64-th gray-scale $G_{64}$ is a "black" gray-scale that is represented as the darkest color on the liquid crystal display panel. Thus, except for the first gray-scale $G_1$ and the 64-th gray-scale G64, the remaining gray-scales $G_8$, $G_{16}$, . . . , $G_{56}$ are considered to be "gray" gray-scales.

When the driving device 100 is arranged in a liquid crystal display (LCD) operated in a normally white mode (i.e., outputs a white image when the common voltage Vcom is applied as the data voltage to all pixels), the black gray-scale is defined as the highest gray-scale voltage $V_{G1}$ and the lowest gray-scale voltage $V_{G18}$ among the gray-scale voltages generated from the gray-scale voltage generator 150. And the white gray-scale is defined as intermediate gray-scale voltages between the highest gray-scale voltage and the lowest gray-scale voltage. Thus the white gray-scale voltages are defined as gray-scale voltages $V_{G9}$ and $V_{G10}$ closest to the common voltage Vcom.

When the common voltage Vcom is commonly applied to both the first and second reference terminals 152 and 154, the resistor strings $R_{G1}$~$R_{G18}$ generate common gray-scale voltages $V_{G1}$~$V_{G18}$ each having the same voltage level as the common voltage Vcom. Thus, when the common voltage Vcom is commonly applied to both the first and second reference terminals 152 and 154, the common gray-scale voltages $V_{G1}$~$V_{G18}$ have substantially the same voltage level with the common voltage Vcom because there is no voltage difference to be divided between the first and second reference terminals 152 and 154.

Accordingly, when the common voltage Vcom is commonly applied to both the first and second reference terminals 152 and 154, the ascending (positive polarity) gray-scale voltages $V_{G1}$~$V_{G9}$ have the same voltage level as the lowest gray-scale voltage $V_{G9}$ corresponding to the first gray-scale $G_1$ (i.e., a white level). Also, the descending (negative polarity) gray-scale voltages $V_{G10}$~$V_{G18}$ have the same voltage level as the highest gray-scale voltage $V_{G10}$ corresponding to the first gray-scale $G_1$ (i.e., a white level). In the present exemplary embodiment, the lowest gray-scale voltage $V_{G9}$ among the ascending (positive polarity) gray-scale voltages $V_{G1}$~$V_{G9}$ and the highest gray-scale voltage $V_{G10}$ among the descending (negative polarity) gray-scale voltages $V_{G10}$~$V_{G18}$ all have the same ("white") voltage level as that of the common voltage Vcom (see FIG. 6), and thus the gray-scale voltages $V_{G1}$~$V_{G18}$ output during this power-down mode of operation are referred to herein as "common gray-scale voltages".

Figure 5:
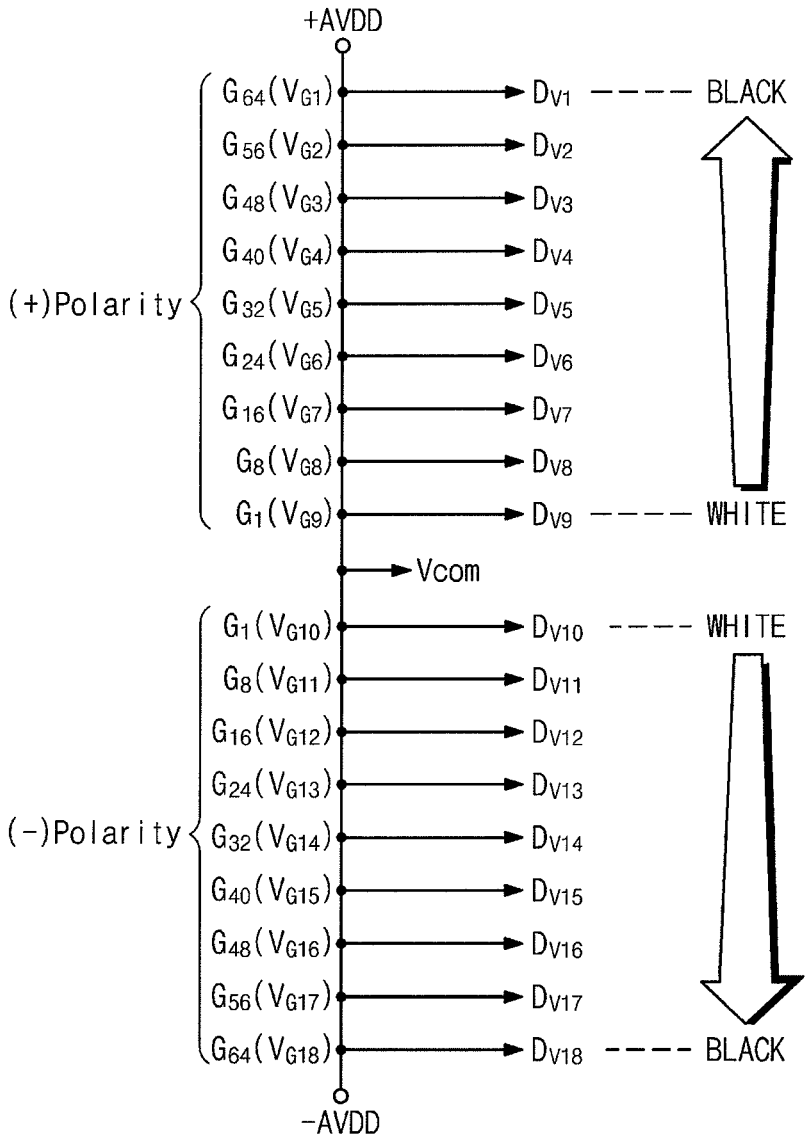
FIG. 5 is a schematic diagram showing voltage levels of data voltages with respect to gray-scales output from a data driver 164 of FIG. 1 prior to the power-down of a driving device of FIG. 1.

FIG. 5 is a schematic diagram showing voltage levels of data voltages with respect to gray-scales output from the data driver of FIG. 1 prior to the power-down mode of the driving device.

Referring to FIG. 5, in order to prevent a deterioration of liquid crystal layer arranged in the liquid crystal display panel, the data voltage output from the data driver 162 alternately swings from a positive polarity voltage level to a negative polarity voltage level with reference to the common voltage Vcom.

The voltage levels of the data voltages are divided into a positive period (+) during which the voltage level range from the common voltage Vcom by a predetermined voltage level and a negative period (−) during which the voltage level decreases from the common voltage Vcom by a predetermined voltage level.

According to gray-scale values $G_1$~$G_{64}$, first to ninth data voltages $D_{V1}$~$D_{V9}$ are used during the positive period (+), and tenth to eighteenth data voltages $D_{V10}$~$D_{V18}$ are used during the negative period (−).

The ninth data voltage $D_{V9}$ is closest to the common voltage Vcom in the positive period (+) and represents the white gray-scale. In the positive period (+), as the gray-scales become closer to the first data voltage $D_{V1}$, the gray-scales become farther from the common voltage Vcom and get nearer to the black-gray scale. Therefore, the first data voltage $D_{V1}$ represents the black gray-scale.

The tenth data voltage $D_{V10}$ is closest to the common voltage Vcom in the negative period (−) and represents the white gray-scale. In the negative period (−), as the gray-scale become closer to the eighteenth data voltage $D_{V18}$, the gray-scales become farther from the common voltage Vcom and get nearer to the black gray-scale. Thus, the eighteenth data voltage $D_{V18}$ represents the black gray-scale.

Figure 6:
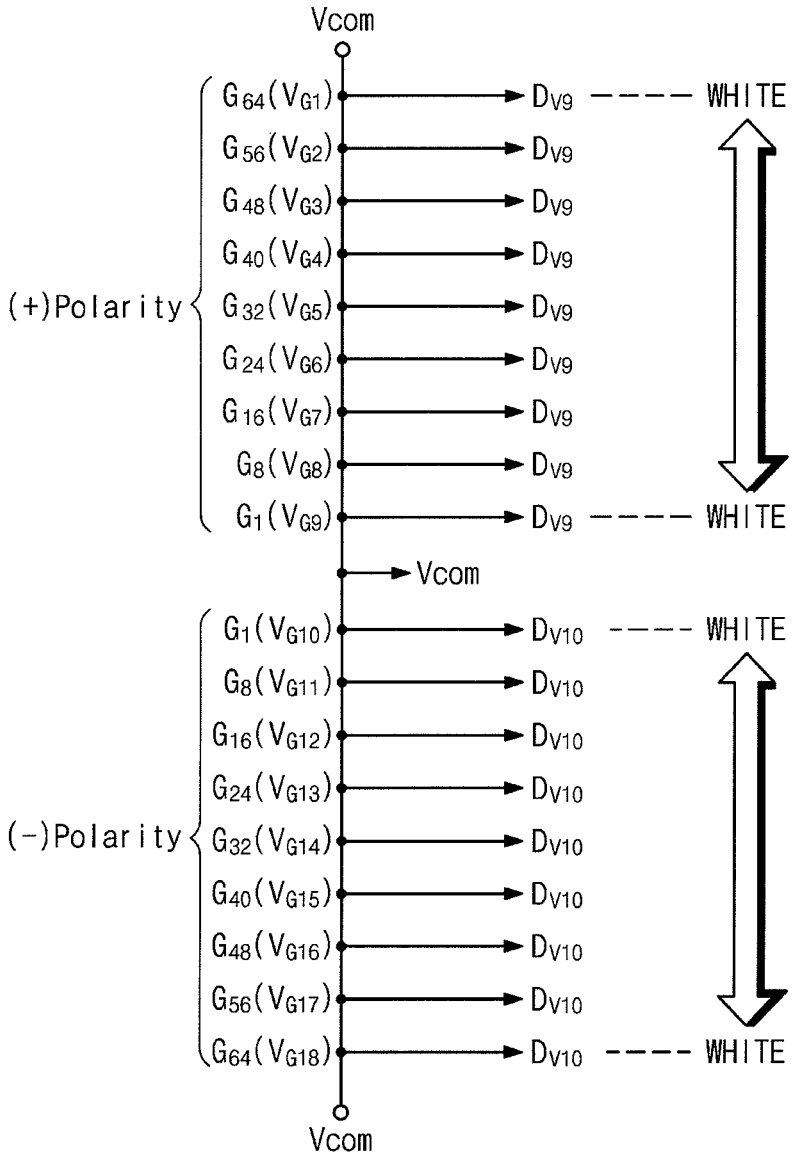
FIG. 6 is a schematic diagram showing voltage levels of data voltages with respect to gray-scales output from a data driver 164 of FIG. 1 during the power-down of a driving device of FIG. 1.

FIG. 6 is a schematic diagram showing voltage levels of data voltages with respect to gray-scales output from the data driver 164 of FIG. 1 during the power-down of the driving device.

Referring to FIG. 6, all the gray-scale voltages generated from the gray-scale voltage generator 150 have substantially the same voltage level as that of the common voltage Vcom during the power-down.

Accordingly, during the power-down, only the data voltage corresponding to a gray-scale voltage that is closest to the common voltage Vcom is output from the data driver 162.

Particularly, in the positive period (+), only the common voltage Vcom is output as the gray-scale values $G_1$~$G_{64}$.

Also, in the negative period (−), only the common voltage Vcom is output as the gray-scale values $G_1$~$G_{64}$. In the present exemplary embodiment, the ninth data voltage $D_{V9}$ in the positive period (+) has substantially same common voltage level (Vcom) as that of the tenth data voltage $D_{V10}$ in the negative period (−).

Accordingly, the only data voltage output from the data driver 162 during the power-down is the "white" voltage.

Figure 7:
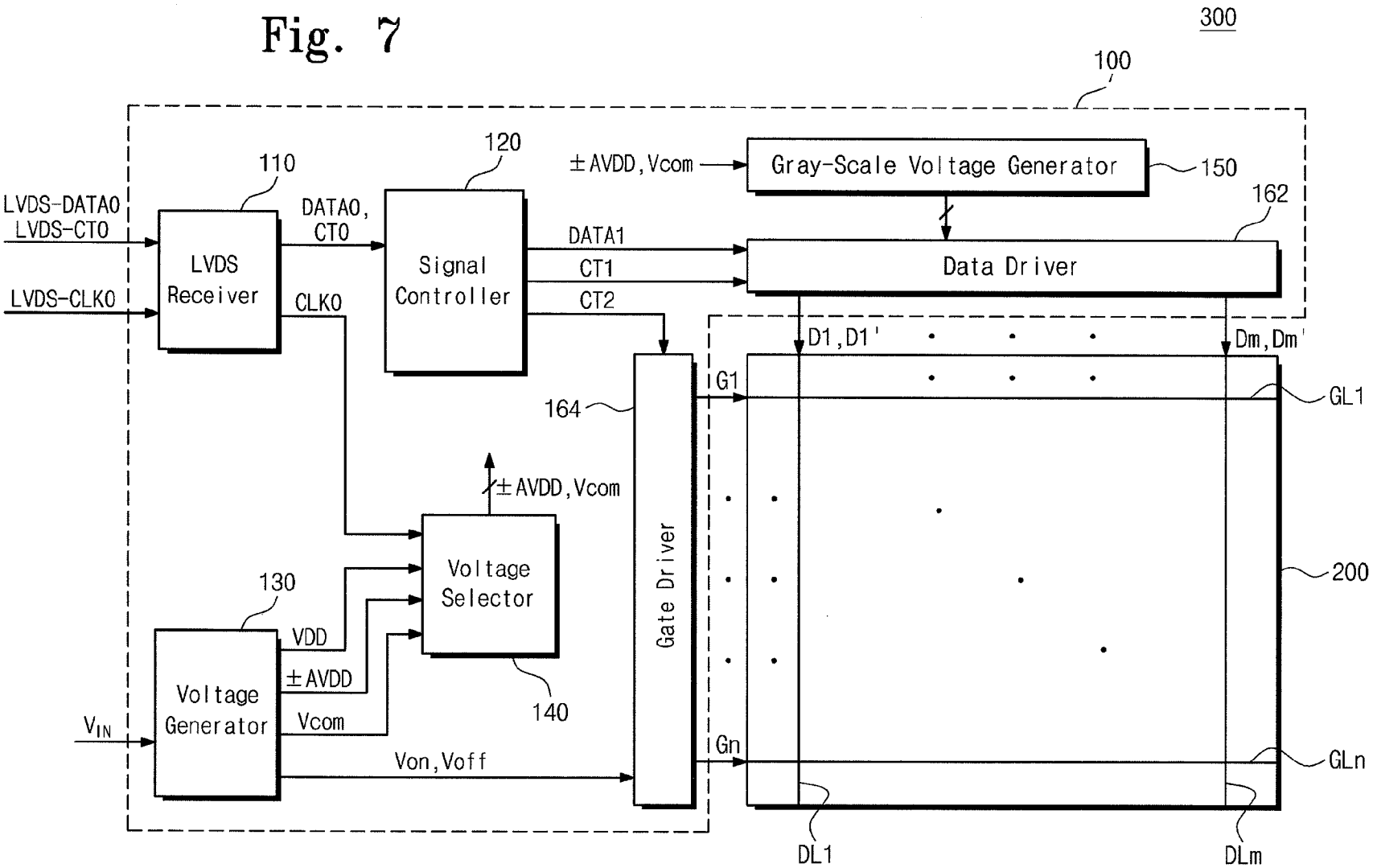
FIG. 7 is a block diagram of a liquid crystal display according to an exemplary embodiment of the present invention.

FIG. 7 is a block diagram showing of a liquid crystal display according to an exemplary embodiment of the present invention. In FIG. 7, the same reference numerals denote the same elements in FIG. 1, and thus the detailed descriptions of the same elements will not be repeated here.

Referring to FIG. 7, a liquid crystal display (LCD) 300 includes a driving device 100 and a liquid crystal display panel 200.

The driving device 100 outputs the gate voltages G~Gn, and selectively outputs the image data voltages D1~Dm and the common data voltages D1'~Dm'. The driving device 100 provides the image data voltages D1~Dm that are generated using normal gray-scale voltages to the liquid crystal display panel 200 prior to the power-down time initiated by a user or (power-saving) program, and provides the common data voltages D1'~Dm' that are generated using common gray-scale voltages to the liquid crystal display panel 200 during the power-down.

The liquid crystal display panel 200 includes a plurality of gate lines GL1~GLn sequentially receiving the gate voltages G1~Gn and a plurality of data lines DL1~DLm that are insulating from and intersecting with the gate lines GL1~GLn. A plurality of pixel areas is defined by the gate lines GL1~GLn and the data lines DL1~DLm.

Pixels are arranged in the pixel areas in a one-to-one correspondence relationship. Each pixel is electrically connected to a corresponding gate line and a corresponding data line to display an image in response to a corresponding gate voltage of the gate voltages G1~Gn and a corresponding data voltage of the data voltages D1~Dm or D1'~Dm' provided through the corresponding gate and data lines, respectively. The images displayed through the pixels are realized as an image corresponding to one frame.

Also, the liquid crystal display panel 200 includes a liquid crystal layer operated in the normally white mode. The liquid crystal layer operated in the normally white mode has a high light transmittance when a data voltage is not applied or a data voltage at a very low level is applied. Thus, the liquid crystal display panel 200 displays a white color.

Accordingly, a pixel that receives a data voltage having a voltage level equal to or near to that of the common voltage Vcom displays a white color or a gray color similar to the white color.

The liquid crystal display panel 200 receives the image data voltages D1~Dm from the data driver 162 to display the normal image and receives the common data voltages D1'~Dm' from the data driver 162 during the power-down to display the abnormal (white) image.

The common data voltages D1'~Dm' have voltage levels that are equal to or near to that of the common voltage Vcom regardless of the gray-scale value information obtained from a data signal DATA1 received from the signal controller 120. The common data voltages D1'~Dm' have voltage levels that are substantially equal to or near to that of the common voltage Vcom. Therefore, the liquid crystal display panel 200 that receives the common data voltages D1'~Dm' displays the white image or the gray image similar to the white image.

Consequently, the LCD 300 displays the white image during the power-down, thereby preventing an after-image from being displayed thereon.

The common data voltages D1'~Dm' corresponding to the abnormal white image have voltage levels that are equal to or near to the common voltage Vcom. Thus, electric charges accumulated in the liquid crystal layer are easily discharged, and during the power-down, the after-image may be prevented more effectively by readily discharging the electric charges accumulated in the liquid crystal layer.

Figure 8:
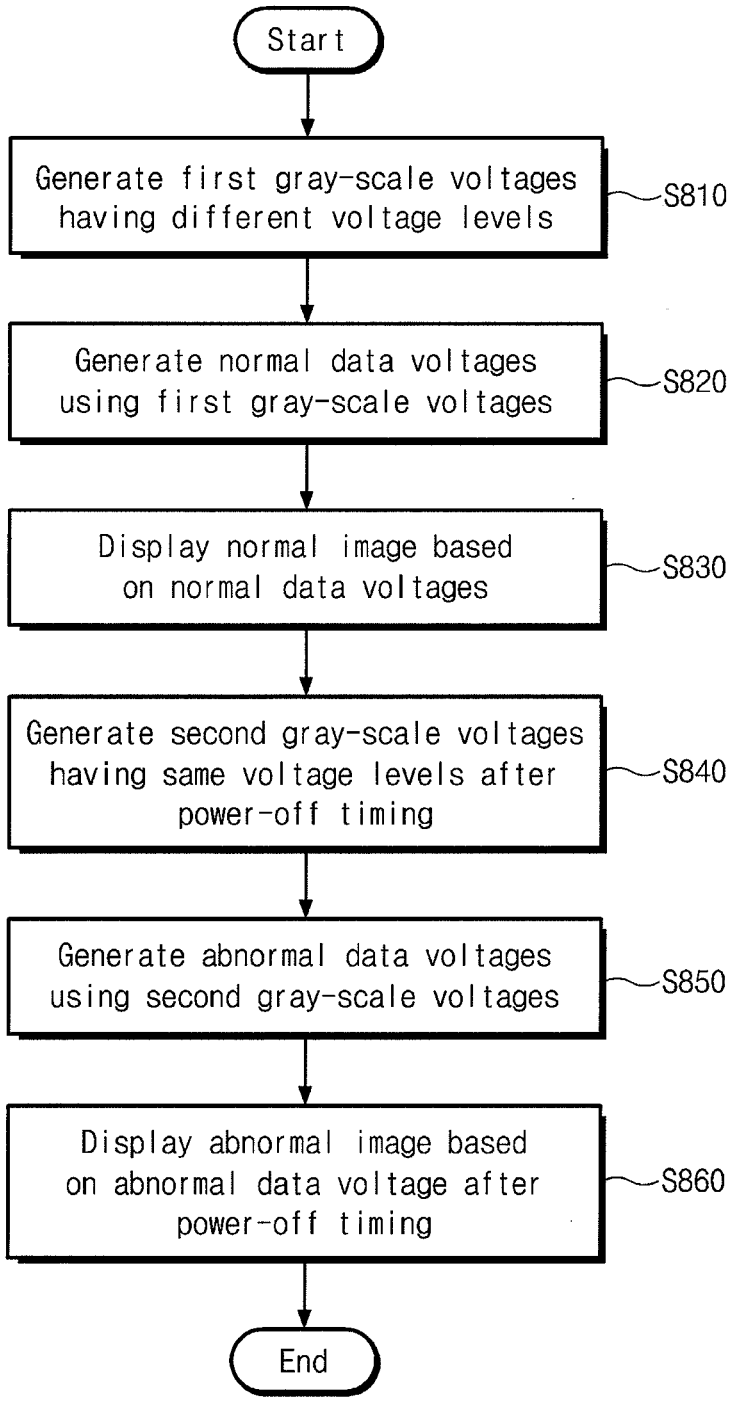
FIG. 8 is a flowchart illustrating a method of driving the liquid crystal display of FIG. 7.

FIG. 8 is a flowchart illustrating a method of driving the liquid crystal display of FIG. 7.

Referring to FIG. 8, the first (normal) gray-scale voltages having different voltage levels corresponding to between the positive power voltage +AVDD and the negative power voltage −AVDD are generated (S810). Then, the data signals corresponding to the images are changed to the image data voltages D1~Dm using the first (normal) gray-scale voltages (S820). The normal image is displayed in response to the image data voltages D1~Dm (S830). Then, during the power-down of the LCD, the second (common) gray-scale voltages having the same voltage level as that of the common voltage Vcom are generated (S840). The common voltage Vcom has the voltage level equal to an intermediate (e.g., the mean) value between the positive power voltage +AVDD and the negative power voltage −AVDD. The data signal corresponding to the image is changed to the common data voltages D1'~Dm' using the second (common) gray-scale voltages (S850). The abnormal (white) image is displayed based on the common data voltages during the power-down (S860).

According to the principles of the invention, when the LCD is turned OFF, the white image is displayed by all pixels.

In this case, the data voltage corresponding to the white image is equal to or near to the common voltage.

Thus, the electric charges accumulated in the liquid crystal layer may be easily discharged, thereby effectively removing the after-image appearing on the LCD during or after the power-down of the LCD.

What is claimed is:

1. A driving device for outputting data voltages to a plurality of data lines, comprising:

a data driver configured to output the data voltages, a voltage selector including first and second output terminals and configured to receive a power-down mode signal, a first voltage, a second voltage having a lower voltage level than that of the first voltage, and a third voltage between the first voltage and the second voltage, and configured to output the first voltage and the second voltage at its first and second output terminals, respectively, where the power-down mode signal is in a logic high state, and configured to output the third voltage to both of the first and second output terminals when the power-down mode signal is in a logic low state, and a gray-scale voltage generator including first and second reference terminals respectively electrically connected to the first and second output terminals, and including a resistor string connected in series between the first reference terminal and the second reference terminal, wherein the gray-scale voltage generator is configured to generate a plurality of gray-scale voltages having different voltage levels by voltage-dividing the first and second voltages when the power-down mode signal is in the logic high state, and configured to output a plurality of gray-scale voltages having the same voltage level as the third voltage when the power-down mode signal is in the logic low state, wherein the gray-scale voltages output by the gray-scale voltage generator are output to the data driver, wherein the gray-scale voltage generator further includes a third reference terminal through which the third voltage is supplied to the gray-scale voltage generator regardless of the power-down mode signal, wherein the third voltage is a common voltage approximately equal to the mean value between the first power voltage and the second power voltage, and wherein the voltage selector comprises:

a first selection circuit configured to select and output through the first output terminal the first voltage when the power-down mode signal is in the logic high state and the third voltage when the power-down mode signal is in the logic low state; and a second selection circuit configured to output through the second output terminal the second voltage when the power-down mode signal is in the logic high state and the third voltage when the power-down mode signal is in the logic low state.

2. The driving device of claim 1, wherein the first selection circuit comprises:

a first switching part having a first switching-control terminal, and configured to output the first voltage through the first output terminal while the power-down mode signal having the logic high state is applied to the first switching-control terminal; and a second switching part having a second switching-control terminal, and configured to output the third voltage through the first output terminal while the power-down mode signal having the logic low state that is opposite to the logic high state is applied to the second switching-control terminal; and the second selection circuit comprises a third switching part having a third switching-control terminal, configured to output the second voltage through the second output terminal while the power-down mode signal having the logic high state is applied to the third switching-control terminal, and configured to output the third voltage through the second output terminal while the power-down mode signal having the logic low state is applied to the third switching-control terminal.

3. The driving device of claim 1, further comprising a signal controller configured to output image data corresponding to an image to the data driver.

4. A liquid crystal display comprising:

a liquid crystal display panel configured to display an image using a plurality of pixels based on data voltages applied to the pixels;

a data driver configured to output the data voltages wherein the voltage level of each data voltage is based on a gray-scale voltage dynamically selected from among a dynamically selected plurality of gray-scale voltages, wherein the selected plurality of gray-scale voltages is selected from among a plurality of normal gray-scale voltages and a plurality of common gray-scale voltages, wherein each of the common gray-scale voltages is substantially equal to a common voltage;

a gray-scale voltage generator having first and second reference terminals, wherein the gray-scale voltage generator generates the plurality of normal gray-scale voltages while a positive voltage higher than the common voltage and a negative voltage lower than the common voltage are applied to the first and second reference terminals, respectively, and wherein the gray-scale voltage generator generates the plurality of common gray-scale voltages while the common voltage is applied to the first reference terminal and to the second reference terminal;

a voltage selector configured to output the positive voltage and the negative voltage to the first and second reference terminals, respectively, when a mode indicating signal is in a logic high state, and configured to output the common voltage to both of the first and second reference terminals when the mode indicating signal is in a logic low signal; and a receiver configured to receive a low voltage differential signal (LVDS) from an external system and configured to convert the low voltage differential signal to the mode indicating signal to be applied to the voltage selector, wherein the gray-scale voltage generator further includes a third reference terminal through which the common voltage is supplied to the gray-scale voltage generator regardless of the mode indicating signal.

5. The liquid crystal display of claim 4, wherein while the selected plurality of gray-scale voltages is the plurality of common gray-scale voltages, the image displayed is a white image.

6. The liquid crystal display of claim 4, wherein while the selected plurality of gray-scale voltages is the plurality of normal gray-scale voltages, the data voltages correspond to image data.

7. The liquid crystal display of claim 4, wherein the liquid crystal display panel displays the image by an inversion driving method in which the polarity of the data voltage is inverted at every frame and wherein the plurality of normal gray-scale voltages is an alternately selected one of a plurality of positive-polarity gray-scale voltages and a plurality of negative-polarity gray-scale voltages.

8. The liquid crystal display of claim 4, wherein the voltage selector comprises:

a first selection circuit configured to output to the first reference terminal the positive voltage when the mode-indicating signal is in the logic high state and the common voltage when the mode-indicating signal is in the logic low state; and a second selection circuit configured to output to the second reference terminal the negative voltage when the mode-indicating signal is in the logic high state and the common voltage when the mode-indicating signal is in the logic low state.

9. The liquid crystal display of claim 8, wherein the first selection circuit comprises a first switching part configured to output the positive voltage through the first reference terminal while receiving the mode-indicating signal having the logic high state and a second switching part configured to output the common voltage through the first reference terminal while receiving the mode-indicating signal having the logic low state, and the second selection circuit comprises a third switching part configured to output the negative voltage through the second reference terminal while receiving the mode-indicating signal having the logic high state and configured to output the common voltage through the second reference terminal while receiving the mode-indicating signal having the logic low state.

10. The liquid crystal display of claim 4, wherein the gray-scale voltage generator comprises a resistor string connected in series between the first reference terminal and the second reference terminal.

11. A method of driving a liquid crystal display, the method comprising:

generating first gray-scale voltages having different voltage levels from each other corresponding to a voltage division of a first voltage and a second voltage;

displaying a normal image using selections among the first gray-scale voltages based on image data;

receiving a low voltage differential signal (LVDS) from an external system;

converting the low voltage differential signal to a mode indicating signal;

generating second gray-scale voltages each having the same voltage level as a third voltage having an intermediate value between the first voltage and the second voltage when the mode indicating signal is in a logic low state;

displaying an image using the second gray-scale voltages when the mode indicating signal is in the logic low state, wherein an LVDS transmitter in the external system converts the mode indicating signal to the low voltage differential signal; and supplying the third voltage to a gray-scale voltage generator through an intermediate terminal of the gray-scale voltage generator regardless of the mode indicating signal, wherein the gray-scale voltage generator includes a first terminal through which the first voltage is supplied, a second terminal through which the second voltage is supplied, and the intermediate terminal between the first and second terminals.

12. The method of claim 11, wherein the third voltage is a common voltage.

13. The method of claim 11, wherein the image displayed when the mode indicating signal is in the logic low state is a white image.

* * * * *